United States Patent [19]

Moriyama et al.

[11] Patent Number: 4,581,917

[45] Date of Patent: Apr. 15, 1986

[54] FORMING DISC EXCHANGING METHOD AND APPARATUS

[75] Inventors: Yukinori Moriyama; Kazuhide Kodama, both of Yamaguchi, Japan

[73] Assignee: Teijin Seiki Company Limited, Japan

[21] Appl. No.: 590,459

[22] Filed: Mar. 16, 1984

[30] Foreign Application Priority Data

Mar. 22, 1983 [JP] Japan ..... 58-46011

[51] Int. Cl.[4] ..... B21J 13/00

[52] U.S. Cl. ..... 72/446; 72/481; 72/381; 140/105; 29/335; 29/568

[58] Field of Search ..... 72/446, 447, 481, 239, 72/448, 384, 403, 381; 140/105 R; 29/33 S, 33 Q, 568; 403/399, 407, 408

[56] References Cited

U.S. PATENT DOCUMENTS

| | | | |
|---|---|---|---|
| 3,134,350 | 5/1964 | Danly et al. | 72/446 |
| 3,559,522 | 2/1971 | Valente | 72/446 |
| 3,800,648 | 4/1974 | Nishiyori et al. | 72/239 |
| 4,005,594 | 2/1977 | Reth et al. | 72/239 |
| 4,457,160 | 7/1984 | Wunsch | 72/446 |

FOREIGN PATENT DOCUMENTS

| | | | |
|---|---|---|---|
| 1496227 | 8/1967 | France | 403/349 |
| 898273 | 6/1962 | United Kingdom | 140/105 |

*Primary Examiner*—Lowell A. Larson
*Assistant Examiner*—David B. Jones
*Attorney, Agent, or Firm*—Finnegan, Henderson, Farabow, Garrett & Dunner

[57] ABSTRACT

A forming disc exchanging method and apparatus for use in a forming apparatus for performing bending operations in multiple directions by timing and sequentially operating a plurality of bending slides. The forming apparatus includes a forming disc which includes a plurality of bending slides, a gear mechanism for actuating the bending slides, a product discharging device and a mold. A main forming machine has the forming disc removably attached thereto and includes a guide structure for allowing the disc to slide thereon. Further included is a truck which includes a drive device having the forming disc removably attached thereto for turning the gears, guides for allowing the disc to slide thereon, and a transfer device for sliding and transferring the forming disc.

11 Claims, 39 Drawing Figures

142'
144
142
143
141

R
120
121
122
111
101
147
150
149
149'
140
153
152
155
M
106
160
124
131
123
129
130
127
146
126
125
145
141
K
J
L
174
170
175
173
171
172
170
171
123

FORMING DISC EXCHANGING METHOD AND APPARATUS

BACKGROUND OF THE INVENTION

The present invention relates to a forming apparatus for performing bending operations in multiple directions to form products of desired shapes by feeding, punching and cutting materials such as wires or strips and by timing and sequentially operating a plurality of bending slides. More particularly, the invention relates to both a method of replacing a forming disc having a bending slide attached thereto and an apparatus for practicing that method.

In the forming portion of a conventional forming apparatus of this type used for continuous manufacturing, a plate located at the front of the forming portion is made integral with the machine body so that it cannot be attached or detached and slid. To that integral plate, there are attached bending slides, gear mechanisms for actuating the bending slides, a product discharging device and a mold.

The necessary operations of such an apparatus include the replacement of the molds, changing and checking operations of positioning and timing the bending slides, and repeating operations of adjusting the shape and accuracy of the products and the springs by operating the bending slides. These operations typically require three to eight hours (depending upon the shape and accuracy of the products) to switch between production of two different products. During this work, the normal manufacturing operations of the apparatus have to be stopped.

Several methods of shortening the preparation time by using a standard mold or the like are known. However, products can be formed with a standard mold are limited in number. In any event, fine adjustment of the leading end of a punch still has to be performed. The maximum savings attainable is only about one or two hours.

SUMMARY OF THE INVENTION

It is therefore an object of the present invention to eliminate the drawbacks concomitant with the prior art thus far described.

According to the present invention, a truck is provided, in addition to a main forming machine, for performing a set-up operation. To this effect, there are movably fitted in the front faces of the main forming machine and the truck two forming discs in which are fitted desired mechanisms such as bending slides, a mold and a gear mechanism for driving the bending slides. The portion of the truck in which the forming disc is fitted is enabled to swivel on a pedestal.

During the operation of the main forming machine, a subsequent manufacturing operation is set up at the forming disc on the truck. When the previous operation is ended at the main forming machine, the truck is brought to a position adjacent the main forming machine so that the forming disc having finished the previous operation is moved to the truck. Then, the aforementioned swivel portion of the truck is turned by 180 degrees so that the forming disc having been prepared in advance on the truck is guided to the front and transferred to the main forming machine.

The present invention contemplates the provision of a forming disc exchanging method and apparatus for the main forming machine and has achieved the following advantages:

(1) During the operation of the main forming machine, the preparation of the subsequent operation can be conducted on the truck, and the operation can be shifted to the subsequent one at the end of the previous operation of the main forming machine by transferring and exchanging the forming disc between the main forming machine and the truck. As a result, the time period during which the main forming machine is interrupted is shortened so that the rate of production is significantly improved. Specifically, the exchange operation can be effected in only five to eight minutes, which is far shorter than using the conventional approach.

(2) A variety of discs can be prepared and stored for products of different shapes. Hence, group control is facilitated.

(3) The discs used for mass production can be exchanged and stored. As a result, the reproductivity of identical products is ensured.

(4) Since the truck can be separated from the main forming machine, the preparation for the subsequent operation can be conducted at an arbitrary place, and the truck can be moved adjacent to and joined to the main forming machine so that the discs can be replaced. Thus, there is no limit to the place for preparing the truck.

(5) A so-called "FMS (Flexible Manufacturing System)" can be realized by providing a number or main forming machines and one or plural trucks.

(6) The method and apparatus of the present invention are most suitable for production of multiple kinds of products.

BRIEF DESCRIPTION OF THE DRAWINGS

Other objects, features and advantages of the present invention will become more apparent from the following description taken in conjunction with the accompanying drawings, in which.

DESCRIPTION OF THE PREFERRED EMBODIMENTS

Figure 1:
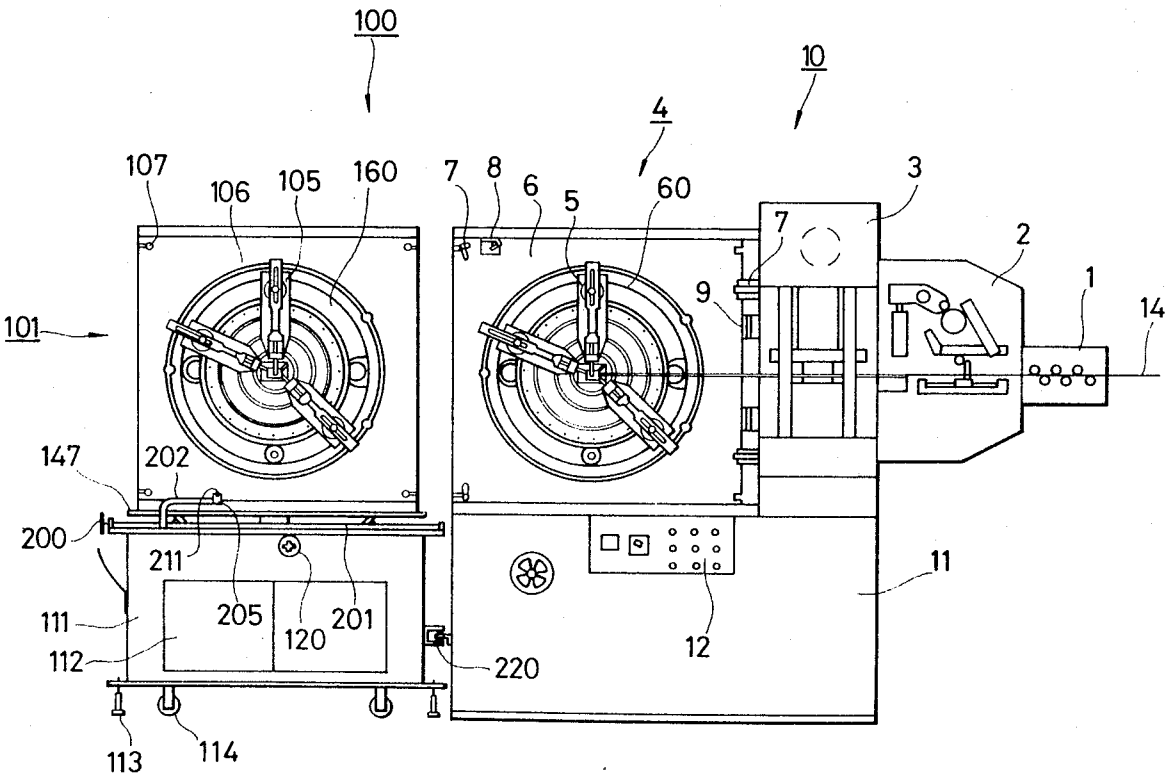
FIG. 1 is a view showing the arrangement of a main forming machine and a truck.

Referring now to the accompanying drawings, FIG. 1 shows the arrangement of a main forming machine 10 at the righthand side and a truck 100 at the lefthand side. In the main forming machine, a material (e.g., a wire or a strip) 14 fed from the right is introduced and advanced through a straightener 1, a feeder 2 and a stamper 3 to a forming unit 4. Indicated at reference numeral 6 is a forming disc which is fitted in the front face of the machine and to which is attached a forming plate 60 carrying bending slides 5 for the forming operation. Indicated at reference numeral 7 is an auto clamp for clamping the forming disc on the forming machine. Reference numeral 8 indicates a manual clamp. Reference numeral 9 indicates a stopper for retaining the forming disc in position. Reference numeral 11 indicates a pedestal portion of the forming machine. Reference numeral 12 indicates a control board equipped with a variety of control switches.

The truck at the lefthand side is composed of a rotary unit 101 on a swivel table 147 and a pedestal 111 therebelow, which is equipped on its lower side with casters 114 and jacks 113 for fixing the truck while the forming discs are being exchanged.

The pedestal 111 is equipped with a storage shelf 112 for storing the bending slides and/or molds. The forming machine and the truck are joined by means of a joint 220 during the exchanging operation of the forming discs. To the upper rotary unit 101, there is fixed a forming disc 106 which is similar to that of the forming machine and which is fixed by means of bolts 107. (The forming disc 106 may be fixed by means of various clamps in the manner of the main forming machine.) To the forming plate 160 fitted in the forming disc there are attached bending slides 105 which are set for the subsequent operation.

Further, reference numeral 120 appearing in the drawings indicates a handle at the front face of the truck, which is used during the preparation for the subsequent operation to drive the bending slides or to rotate the rotary unit 101. Indicated at reference numeral 200 is a handle at the side face of the truck, which is used to rotate a threaded shaft 201 thereby to slide an arm meshing with that threaded shaft to the right and left so that the forming slides may be slid by the slides of the arm through both a lever 205 at the leading end of the arm and a pin 211 attached to the forming disc and engaged with the lever 205. The mechanism of the forming machine and the truck will be subsequently explained.

Figure 2:
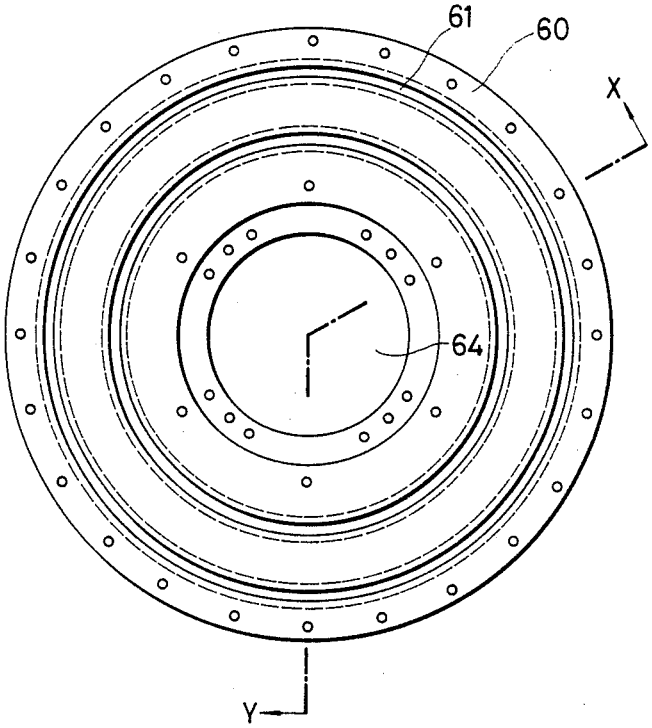
FIG. 2 is a front elevation showing a forming plate.
Figure 3:
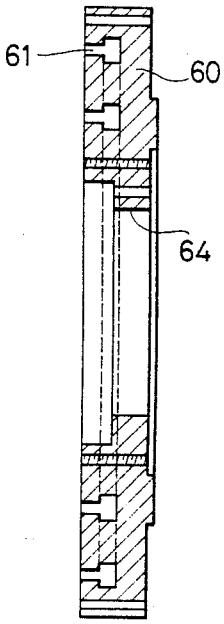
FIG. 3 is a section taken along a line X—Y of FIG. 2.

FIG. 2 is a front elevation showing the forming plate 50, and FIG. 3 is a section taken along line X—Y in FIG. 2, in which reference numeral 61 indicates a groove for mounting the bending slide, and reference numeral 64 indicates a center hole.

Figure 4:
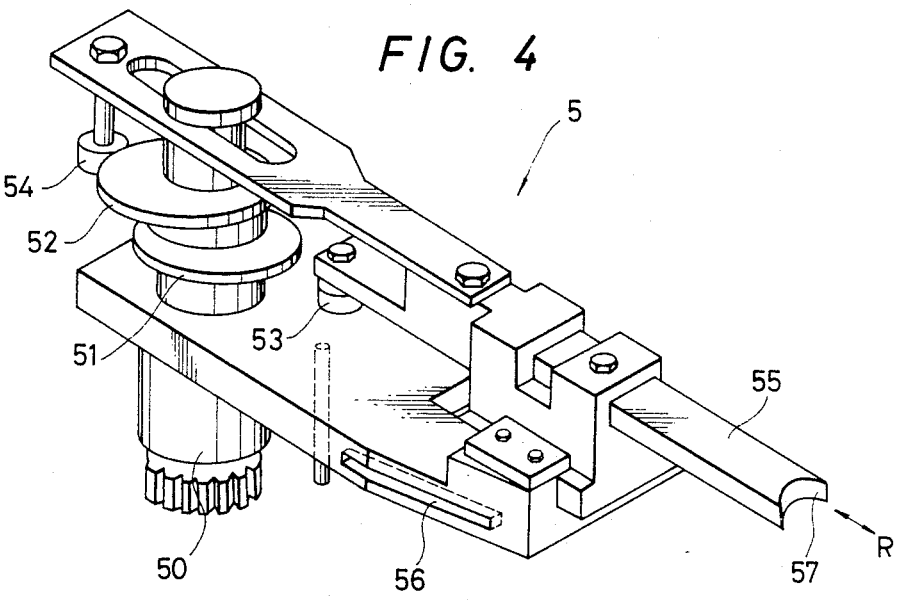
FIG. 4 is a perspective view showing a bending slide.

FIG. 4 is a perspective view showing the bending slide 5, in which reference numeral 50 indicates a pinion meshing with a driving sun gear, reference numeral 51 a push cam, reference numeral 52 a return cam, reference numeral 53 a push roller engaging with the push cam, and reference numeral 54 a return roller engaging with the return cam. A slider 55 is driven to the right and left, as indicated by an arrow R, to work the material by the action of a punch 57 at the leading end thereof.

Indicated at reference numeral 56 is a mounting groove which mounts the bending slide 5 in the forming plate 60 by interposing a mounting member between itself and the groove 61 of the aforementioned forming plate.

Figure 5:
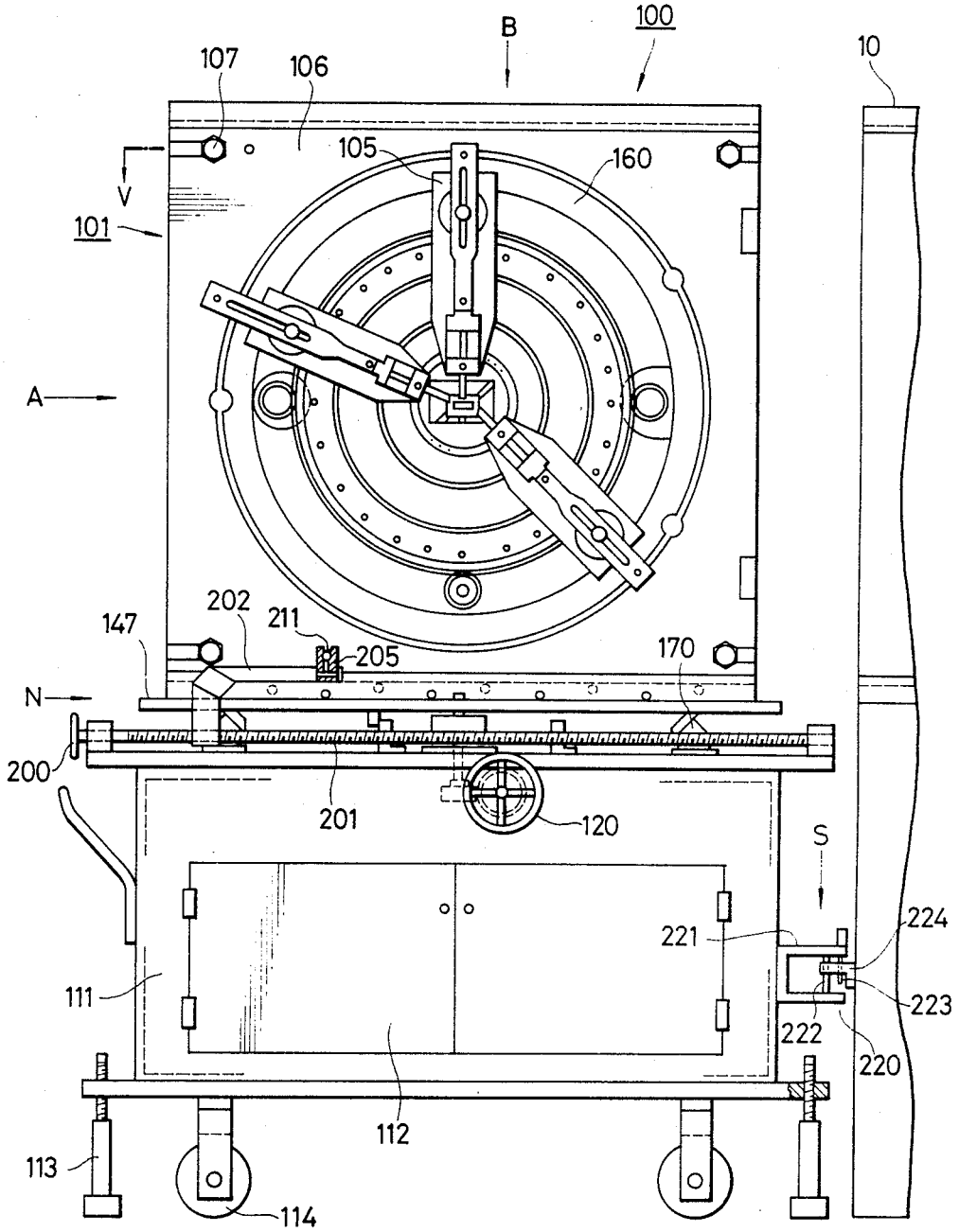
FIG. 5 is a front elevation showing the truck.

FIG. 5 is a front elevation showing the truck 100, in which the forming disc 106 is mounted by means of the bolts 107. Reference numeral 105 indicates the bending slide which is mounted in the forming plate 160. These portions are held as the rotary unit 101 on the swivel table 147 and are rotatably supported on supports 170 above the underlying pedestal 111. Reference numeral 120 indicates the handle at the front face, which is made operative to rotate the rotary unit 101 or to drive the bending slides for the adjustment. (This mechanism will be described with reference to FIG. 10.) Reference numeral 200 indicates the handle at the side face, which is used to turn the threaded shaft 201 thereby to move the arm 202 meshing therewith to the right and left. Then, the forming disc is moved by the lever 205 at the leading end of the arm 202 through the pin 211 mounting the forming disc 106. Reference numeral 112 indicates a storage shelf for storing the bending slides, the molds etc. Reference numeral 113 indicates jacks for fixing the truck during the exchanging operation of the bending discs. Reference numeral 114 indicates the casters for moving the truck.

Reference numeral 220 indicates the joint for joining the main forming machine 10 and the truck 100. Reference numeral 221 indicates a first bracket which is attached to the truck. Reference numeral 224 indicates a second bracket which is attached to the main forming machine. These two brackets are joined to each other by means of a first pin 222 and an insertion second pin 223. (See FIG. 19.)

Figure 6A:
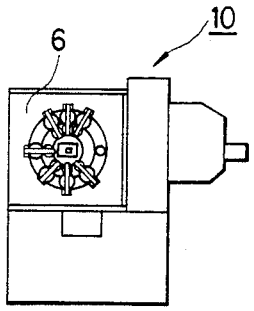
FIG. 6A to 6F are views showing the procedure of exchanging the forming discs.
Figure 6D:
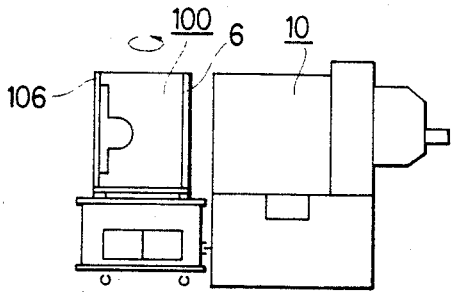
Figure 6B:
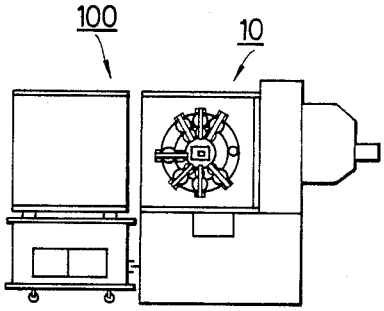
Figure 6E:
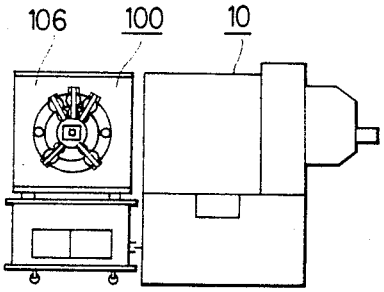
Figure 6C:
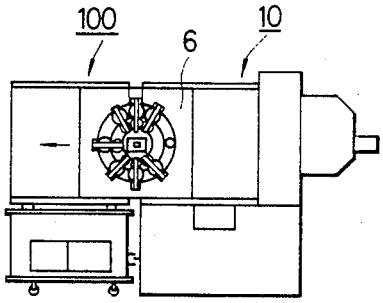
Figure 6F:
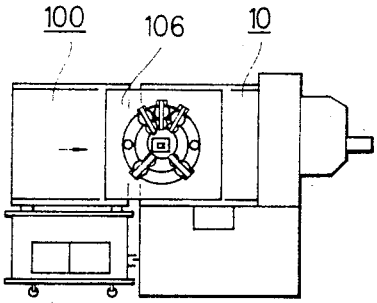

FIGS. 6A through 6F illustrate the procedure of replacing the forming disc of the main forming machine. FIG. 6A shows the state in which the previous operation has been ended in the main forming machine 10. FIG. 6B shows the state in which the truck 100, having its one side holding the forming disc prepared for the subsequent operation and its other side emptied, is brought close to the main forming machine 10 and joined to the main forming machine by means of the joint 220 with its empty side being arranged side by side with the front face of the main forming machine. FIG. 6C shows the state in which the forming disc 6 having finished its operation is being transferred to the truck. FIG. 6D shows the state in which the rotary unit 101 is turned by 180 degrees after it has received the previous forming disc. FIG. 6E shows the state in which the forming disc 106 renewed and prepared for the subsequent operation is brought to the front side of the truck after the turning of the rotary unit 101 by 180 degrees has been completed. FIG. 6F shows the state in which the new forming disc 106 is being transferred to the main forming machine.

Figure 7:
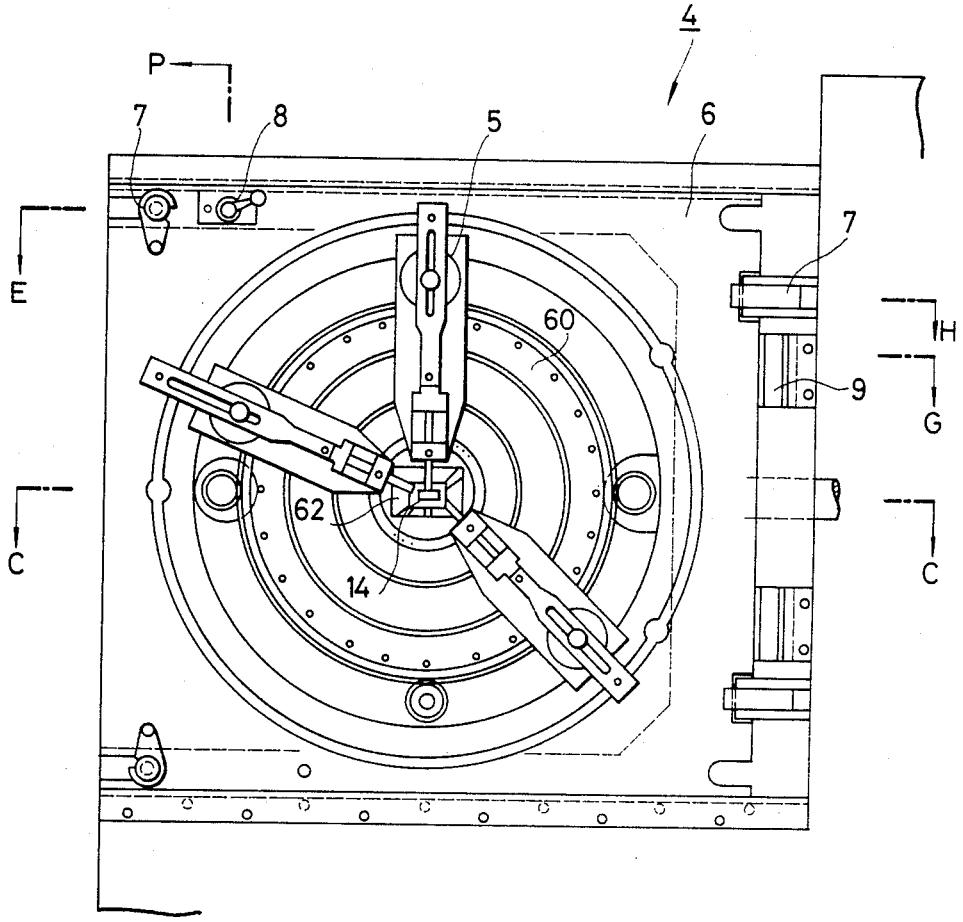
FIG. 7 is a front elevation showing the forming disc.
Figure 8:
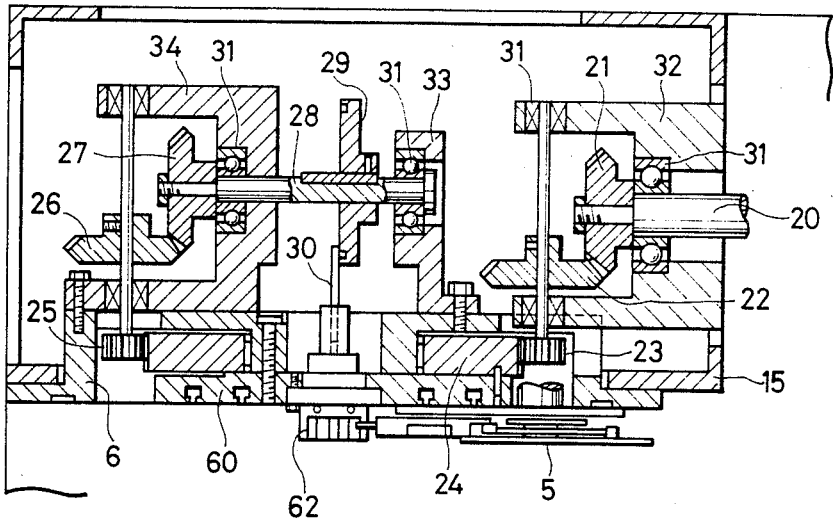
FIG. 8 is a view taken along arrow C—C in FIG. 7.

FIG. 7 is a front elevation showing the forming unit 4 of the main forming machine. FIG. 8 is a view taken along arrow C—C in FIG. 7 showing the driving mechanism for the forming unit. The reference numeral 6 indicates the forming disc which is equipped with the forming plate 60 carrying the bending slides 5. Reference numeral 14 indicates the material to be worked, and reference numeral 62 indicates a mold. Reference numeral 7 indicates auto clamps for clamping the forming disc on the main forming machine, and the reference numeral 8 indicates manual clamps. The reference numeral 9 indicates a stop for accurately positioning the forming disc.

Indicated at reference numeral 20 is the drive shaft of the forming machine, which is made operative to turn a pinion 23 through bevel gears 21 and 22 thereby to drive a sun gear 24 meshing with the pinion 23. The sun gear 24 is attached to the forming disc through a bearing 65. By the sun gear 24, the pinion 50 of each bending slide 5 shown in FIG. 4 is driven to actuate the bending slide 5. In the illustrated embodiment, the gear mechanism for actuating the bending slides is implemented with the sun gear. However, the gear mechanism may be any type that can perform the same function.

In FIG. 8, a pinion 25 meshing with the sun gear 24 rotates a shaft 28 through bevel gears 26 and 27 to rotate a grooved cam 29 mounted on the shaft 28 so that a slider 30 is moved back and forth to protrude the product outside of the mold.

Indicated at reference numeral 32 is a bracket which supports the drive shaft 20, the bevel gears 21 and 22, etc. Reference numerals 33 and 34 indicate brackets which support the bevel gears 26 and 27, the shaft 28, etc. Reference numeral 15 indicates the frame of the main forming machine.

Figure 9:
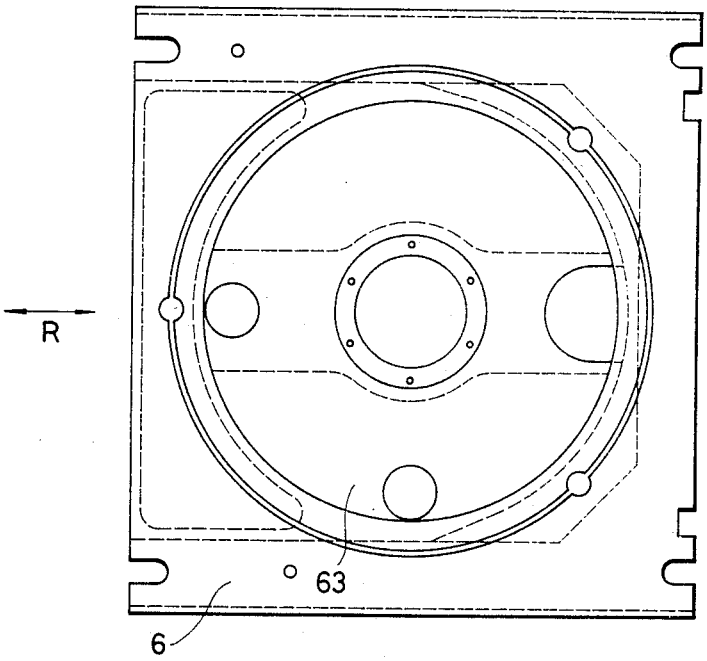
FIG. 9 is a front elevation showing the forming disc.

FIG. 9 is a front elevation showing the forming disc 6. Indicated at reference numeral 63 is a position for mounting the forming plate. An arrow R indicates the moving direction when the forming disc is to be replaced.

As has been described hereinbefore, the mechanism shown in FIG. 8 has been explained as that of the main forming machine. The bracket 32, the drive shaft 20 attached thereto, the bevel gears 21 and 22, and the pinion 23 form together a portion of the main forming machine and are immovable (although the frame 15 also forms a part of the main forming machine) even during the forming disc exchanging operation. To the contrary, the forming disc 6, the forming plate attached thereto, the brackets 33 and 34 are made movable together with the shaft 28, the grooved cam 29, the slider 39 and the bevel gears 26 and 27 all attached to the brackets 33 and 34 and reciprocal between the main forming machine and the truck.

Figures 10A, 10B:
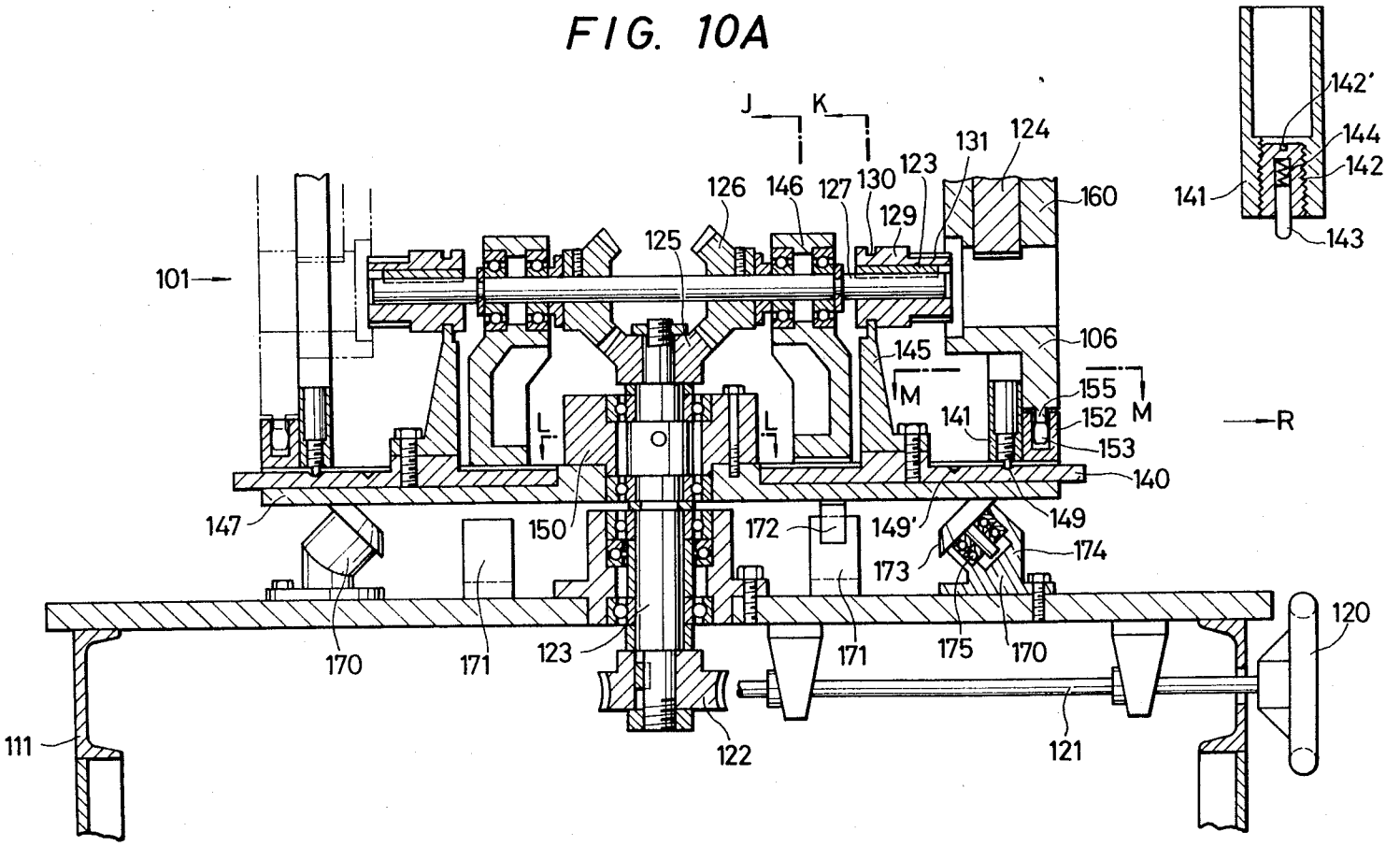
FIG. 10A is a view showing the mechanism of the truck.
FIG. 10B is an enlarged view showing the notched portion.

FIG. 10A shows the central portion of the mechanism of the truck in side section. It is assumed that the arrow R is directed to the front face and that the truck is fed with the forming disc 106 for preparing the subsequent operation. The forming disc 106 (which is indicated at reference numeral 6 on the main forming machine but all have the identical construction, as has been described hereinbefore, because they are sequentially replaced) has a rail 155 attached thereto and rides on rollers 153 in a guide groove 152 so that it can move perpendicularly to the plane of FIG. 10A. (The upper end of the forming disc has a generally similar construction, as will be described hereinafter.) Indicated at reference numeral 124 is a sun gear which is attached to that forming disc.

Reference numeral 120 indicates the handle which is attached to the front face of the truck for turning a shaft 121 to rotate a longitudinal shaft 213 through a worm gear 122. The rotations of the longitudinal shaft 123 can be transmitted to the center boss, as will be described hereinafter. In the state of FIG. 10, the rotation of the longitudinal shaft 123 is not transmitted to a center boss 150, but the rotation of the longitudinal shaft 123 is transmitted through bevel gears 125 and 126 to a transverse shaft 127.

To the leading end of the transverse shaft 127 (i.e., the front or righthand side of the truck which is indicated in the drawing although the opposite side has a similar construction), there is attached through a slide key a clutch 129. This clutch is formed at one end with a groove 130 engaging with a clutch plate 145 and its other end is formed with a pinion 131 meshing with the sun gear 124.

When it is intended to rotate the sun gear 124 for driving the bending slides (although not shown) attached to the forming plate 160 with a view of preparing for a subsequent operation, the clutch 129 is moved to the right together with the cluch plate, which is attached to a slide plate 140, to establish meshing engagement between the pinion 131 and the sun gear 124 if the slide plate 140 is pulled to the right. When the handle 120 is turned, the clutch 129 is turned through the shaft 121, the worm gear 122, the longitudinal shaft 123, the bevel gears 125 and 126, and the transverse shaft 127, as has been described hereinbefore, to rotate the sun gear 124 so that the forming plate is driven by the sun gear.

Indicated at reference numeral 141 is a bracket which is attached to the table 147 across the slide plate 140. As shown in an enlarged view in FIG. 10B, a screw 142 is driven into the bracket 141 to push a piston 143 downward by the action of a spring 144. Moreover, the piston 143 is fitted in a notch 149 or 149', which is formed in the slide plate 140, to position the slide plate. Indicated at reference numeral 146 is a bearing stand which is attached to the table 147.

The mechanisms described above are placed on the swivel table 147 and are supported on supports 170 of the pedestal 111 so that they can swivel together with the center boss 150. Each of the supports 170 is constructed of a bracket 174, a frusto-conical shaft 173, etc. Reference numeral 171 indicates stops which are attached to the pedestal 111, and refernece numeral 172 indicates a stop pad which is attached to the swivel table 147.

As shown in FIG. 10B, the screw 142 is moved up and down, when it is driven at its groove 142' by means of a driver, to change the strength of the spring 144 between itself and the piston 143, thereby to change the pushing force of the slide plate 140 by the piston 143.

Figure 11:
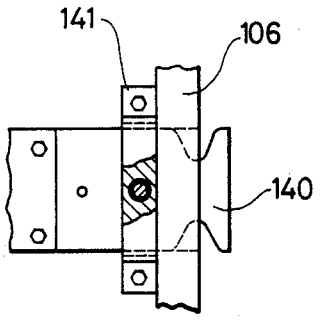
FIG. 11 is a view taken along arrow M—M in FIG. 10.

FIG. 11 is a view taken along the arrows M—M in FIG. 10A, in which the forming plate 106 and the slide plate 140 are shown. Moreover, the bracket 141 is also shown to be attached across the slide plate 140.

Figure 12:
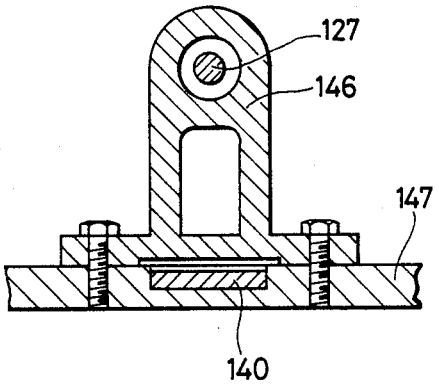
FIG. 12 is a view taken along arrow J in FIG. 10A.
Figure 13:
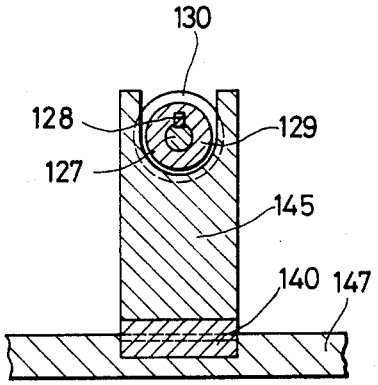
FIG. 13 is a view taken along arrow K in FIG. 10A.
Figure 14:
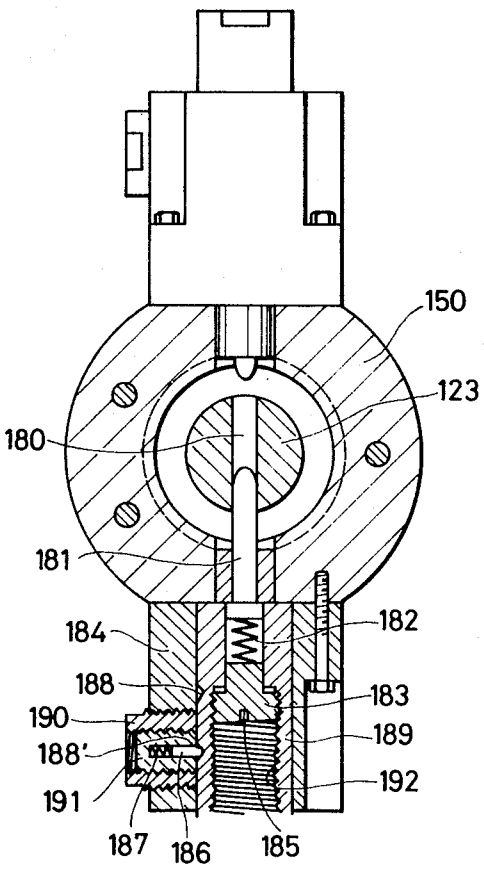
FIG. 14 is a view taken along arrow L—L in FIG. 10A.

FIG. 12 is a view taken along the arrow 3 in FIG. 10A, in which the reference numeral 127 indicates the transverse shaft. Reference numeral 146 indicates the bearing stand which is attached to the swivel table 147. The slide plate 140 is adapted to slide between the bearing stand 146 and the swivel table 147. FIG. 13 is a view taken along the arrow K in FIG. 10A, in which reference numerals 127, 128 and 129 indicate the transverse shaft, the slide key and the clutch, respectively. The groove 130 is fitted on the clutch plate so that it slides together with the slide plate 140 on the table 147. FIG. 14 is a view taken along the arrows L—L in FIG. 10A showing the engagement mechanism of the longitudinal shaft 123 and the center boss 150.

To the center boss 150 there is attached a boss 184, in which a slider 189 is fitted. This slider 189 is internally threaded, as indicated at 192, and a spring holder 183 is driven thereinto so that a slide pin 181 is pushed into the hole 180 of the longitudinal shaft 123 by the action of a spring 182.

Into the side of the boss 184, there is driven a first screw 190, into which a second screw 191 is driven. A piston 186 is urged inwardly by a spring 187. The piston 186 engages with the notches 188 and 188' of the slider 189 to position the slider 189.

When the slider 189 is pushed as shown, the slide pin 181 enters the hole 180 of the longitudinal shaft 123 so that the shaft 123 and the center boss 150 are rotated together. When the handle 120 is turned, as described hereinbefore, the rotary unit 101 of the truck shown in FIG. 10 is rotated. If the slider 180 is pulled to the side, the slide pin 181 comes out of the hole 180 to interrupt the connection between the longitudinal shaft 123 and the center boss 150.

The strength of the spring 182 can be changed if a driver or the like is fitted in the groove 185 of the spring holder 183 to turn and move back and forth the spring holder 183.

Figure 15:
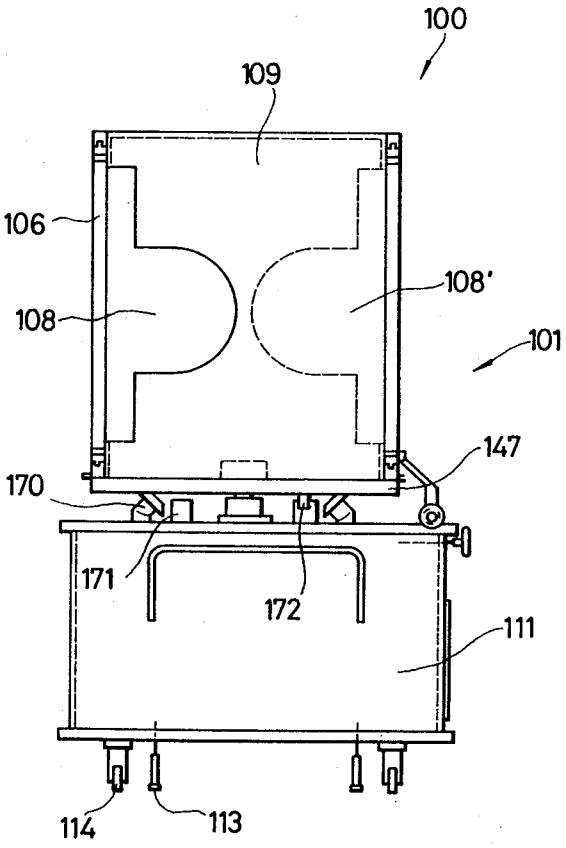
FIG. 15 is a view taken along arrow A in FIG. 5.

FIG. 15 is a view taken along the line A of FIG. 5 and showing the side of the truck. As has been described hereinbefore, reference numerals 100, 101, 147, 106, 109, 111, 170, 171, 172, 113 and 114 indicate the truck, the rotary unit at the upper portion, the swivel table, the forming disc, the side wall, the pedestal, the supports of the rotary unit, the stoppers, the stopper pad, the jacks and the casters, respectively. Moreover, a notch 108 (or 108' at the opposite side) is formed so that the mechanisms attached to the forming disc may pass therethrough when the forming disc moves.

Figure 16:
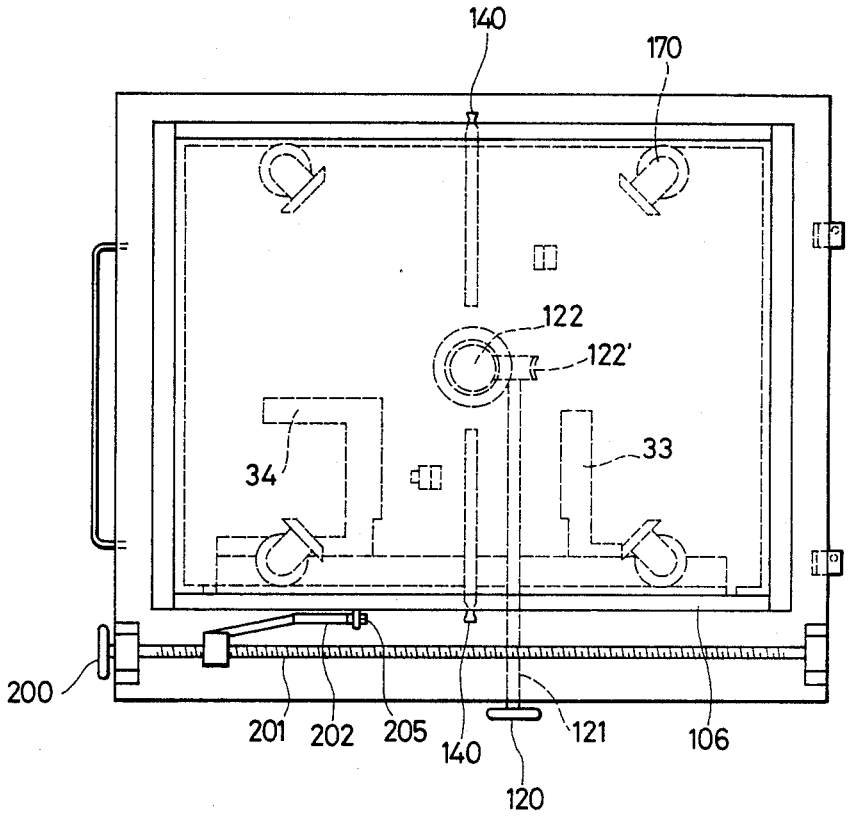
FIG. 16 is a view taken along arrow B in FIG. 5.

FIG. 16 is a view taken along the arrow B in FIG. 5 and showing the top of the truck. Reference numeral 120 indicates the handle at the front face, reference numeral 121 the shaft, reference numeral 122 the worm gear, reference numeral 122' a worm, reference numeral 140 the slide plate, reference numerals 33 and 34 the brackets, reference numeral 106 the forming disc, reference numeral 170 supports of the rotary unit, reference numeral 200 the handle at the side face, reference numeral 201 the threaded shaft, reference numeral 202 an arm meshing with the threaded shaft, reference numeral 205 the lever at the leading end of the arm, and reference numeral 211 a pin which engages with the lever and which is fixed on the forming disc 106.

Figure 17:
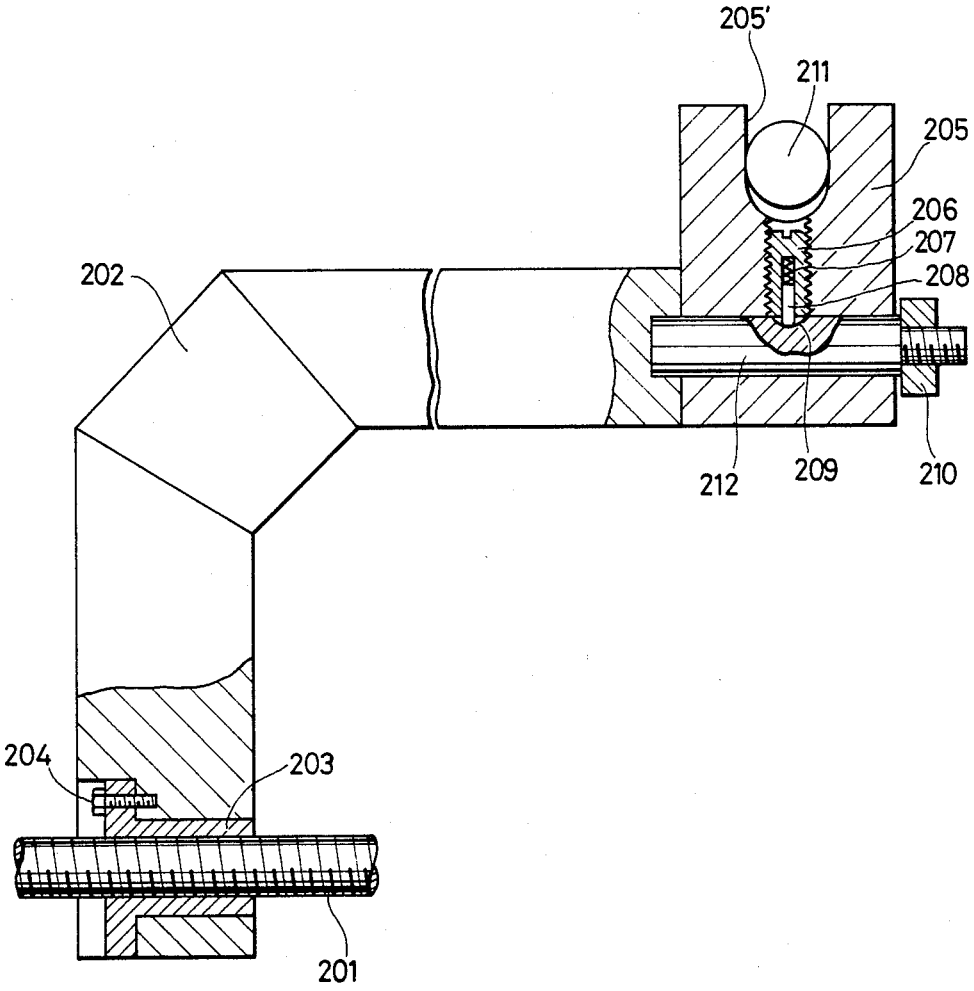
FIG. 17 is a sectional view showing an arm.
Figure 18:
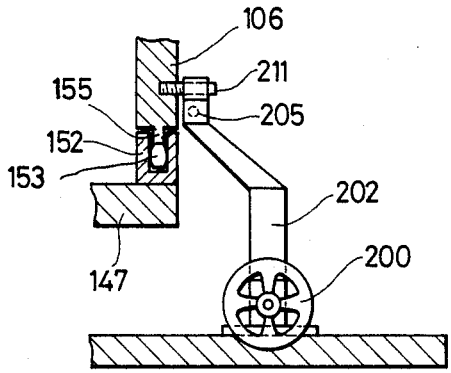
FIG. 18 is a view taken along arrow N in FIG. 5.

FIG. 17 is an enlarged view showing the arm 202, and FIG. 18 is a view taken along the arrow N in FIG. 5. The arm 22 meshes with the threaded shaft 201 through a female screw 203 which is attached by means of bolts 204. The lever 205 is rotatably fitted in a rod, which is fixed on the leading end of the arm 202 and is prevented by means of a nut 210 from coming out. In a fork 205' of the lever 205 is fitted the pin 211 which is screwed into the forming disc 106 so that the forming disc 106 is moved with the arm. Thus, as has been described with reference to FIG. 10A, the rollers 153 on which the rail 155 formed at the lower end of the forming disc 106 are made to run are placed in the guide groove 152 on the swivel table 147. As a result, the forming disc 106 is moved to the right and left when the handle 200 is turned to move the arm 202 to the right and left.

Turning now to FIG. 1, the relationship between the arm and the forming disc will be further described. Since the arm extends rightwardly of the drawing (i.e., toward the main forming machine), the forming disc is transferred together with the arm to the main forming machine at the righthand side by turning the handle 200. Then, before a base portion (i.e., the female screw 203 of FIG. 17) of the arm engaged with the threaded shaft 201 comes to the righthand end of the threaded shaft 201, the lever 205 enters the front face of the main forming machine sufficiently so that the forming disc 106 can be fitted in the main forming machine before the base of the arm 202 arrives at the righthand end of the threaded shaft. Therefore, the lever 205 may be turned in the same direction to release the engagement with the pin thereby to return the arm to the left in the drawing. When the forming disc, having been subjected to this operation, is to be extracted, the forming disc 6 is pulled to the left toward the truck (as shown in FIG. 6C) by bringing the arm to the right to carry the lever 205 at the leading end of the arm to the pin 211 of the forming disc 6, by raising the lever 205 to the forming disc to bring it into engagement with the fork 205' of the lever 205, and by turning the handle 200 to move the arm to the left.

Figure 19:
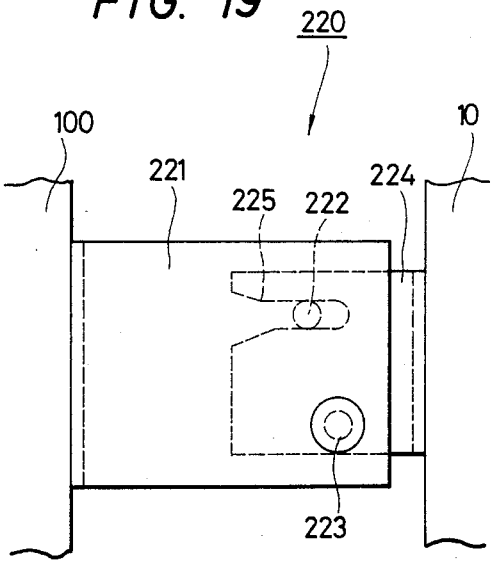
FIG. 19 is a view taken along arrow S in FIG. 5.

FIG. 19 is a view taken along the arrow S in FIG. 5 showing the joint 220 in a top plan view. To the truck at the lefthand side, there is attached the first bracket 221 which is equipped with the first pin 222. To the main forming machine 10 at the righthand side, there is attached the second bracket 224 which is formed with a notch 225 having tapered and straight portions to accommodate the first pin therein. Reference numeral 223 indicates the second pin, which is mounted between the first and second brackets.

Figure 20:
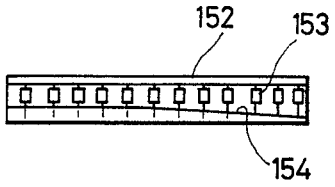
FIG. 20 is a top plan view showing a guide groove in the lower portion of the truck.
Figure 21:
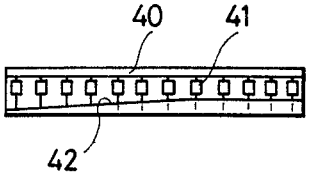
FIG. 21 is a top plan view showing a guide groove in the lower portion of the forming machine.

FIG. 20 is a top plan view showing the guide groove 152 at the side of the truck in which the rollers 153 are fitted. The guide groove 152 is formed into a tapered portion 154 at the side of the main forming machine. As shown in FIG. 21, which is a top plan view, in a guide groove 40 at the side of the main forming chamber in which rollers 41. On the other hand, the guide groove 40 is formed into a tapered portion 42 at the side of the truck. The two tapered portions 40 and 154 are made to extend two thirds of the whole length and to face each other so that the insertion of the forming disc is facilitated.

Figure 22:
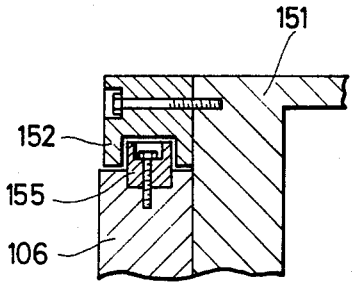
FIG. 22 is a sectional view showing an upper guide groove.
Figure 23:
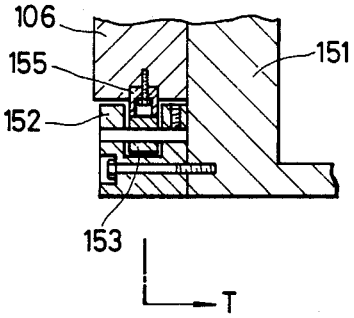
FIG. 23 is a sectional view showing a lower guide groove.
Figure 24:
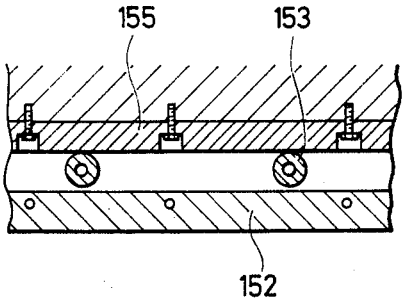
FIG. 24 is a view taken along arrow T in FIG. 23.

FIG. 22 shows the construction on the upper portion of the forming disc 106 (at the side of the truck, as shown, but similar at the side of the main forming machine as in FIGS. 23 and 24). As shown therein, the rail 155 attached to the upper end of the forming disc is made slidable in the guide groove 152 of the frame 151.

FIG. 23 shows the construction of the lower end of the forming disc, and FIG. 24 is a view taken along the arrow T in FIG. 23. To the truck frame 151 is attached the guide groove 152 in which the rollers 153 are fitted. The rail 155 attached to the lower end of the forming disc rides on the rollers 153.

Figure 25:
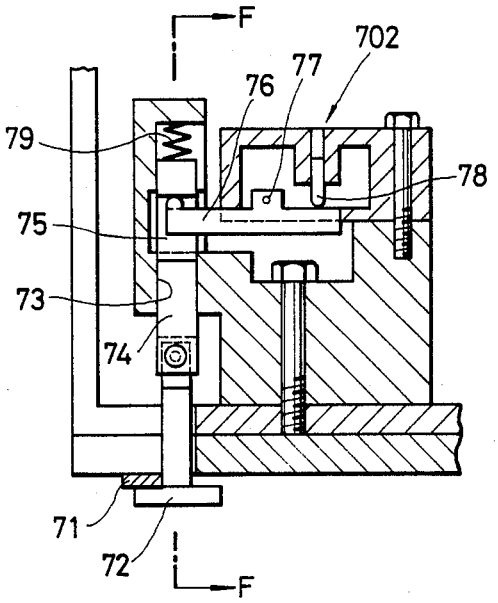
FIG. 25 is a view taken along arrow E in FIG. 7.
Figure 26:
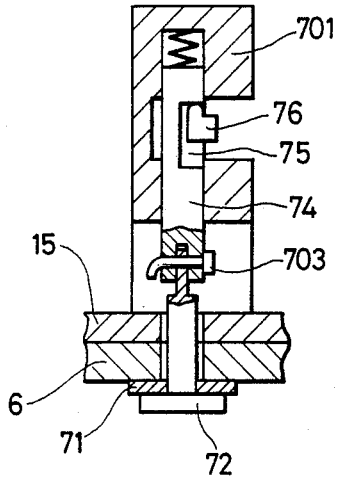
FIG. 26 is a view taken along arrow F in FIG. 25.

FIG. 25 is a view taken along the arrow E in FIG. 7, and FIG. 26 is a view taken along the arrows F—F in FIG. 25 showing the construction of the auto clamps 7 of the forming disc 6 of the forming machine. Indicated at reference numeral 71 is a hook which is attached to the forming disc. Reference numeral 72 indicates a headed pin. Reference numeral 74 indicates a shaft which is connected between the headed pin and a pin 703. The shaft 74 is slidable in a guide hole 73 of a bracket 701, which is attached to the frame 15 of the forming machine but is biased downward by the action of a spring 79. The shaft 74 is formed with a notch 75, in which is fitted one end of a lever 76 supported on a fulcrum 77 in a rocking manner. The other end of the lever 76 is pushed by a piston 78. When atmospheric pressure is applied, to the upper end of the piston 78 (indicated by arrow 702), the lever is inclined clockwise on the fulcrum 77 to push the shaft 74 upward in the drawing (i.e., inwardly of the forming machine) against the action of the spring 79, thereby to fasten the hook 71 by means of the headed pin 72.

Figure 27:
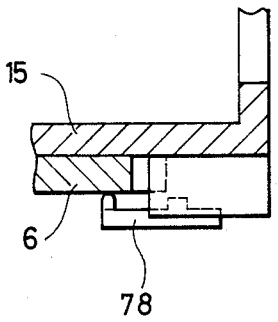
FIG. 27 is a view taken along arrow H in FIG. 7.

FIG. 27 is a view taken along the arrow H in FIG. 7 and also shows the auto clamps 7 for holding the forming disc 6 by the clockwise inclination of the lever 78. The auto clamps 7 have structures as shown in FIG. 26.

Figure 28:
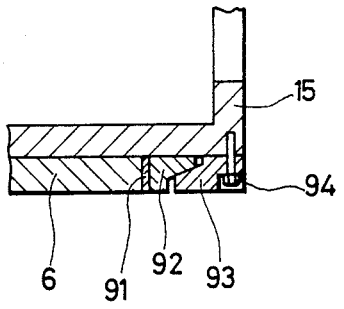
FIG. 28 is a view taken along arrow G in FIG. 7.

FIG. 28 is a view taken along the arrow G in FIG. 7 and shows the construction of the stops 9 used for ensuring the accurate positioning of the forming disc 6. When the forming disc 6 advances from the left, a tapered first member 92, which is attached to the leading end of the forming disc, and a tapered second member 93, which is attached to the frame 15 of the forming machine by means of bolts 94, come into engagement at tapered portions to stop the forming disc in position. When the tapered first member 92 is to be mounted, a distance piece 91 is interposed to make the positioning more accurate.

Figure 29:
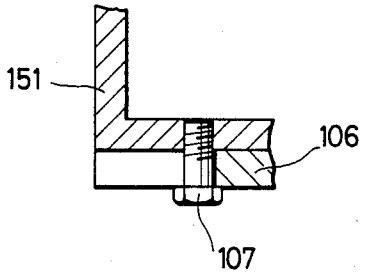
FIG. 29 is a view taken along arrow V in FIG. 5.

FIG. 29 is a view taken along the arrow V in FIG. 5 and shows the state in which the forming disc 106 is attached to the frame 151 of the truck 100 by means of the bolts 107. This attachment may also be effected with auto clamps as described with reference to FIGS. 25 to 27.

Figure 30:
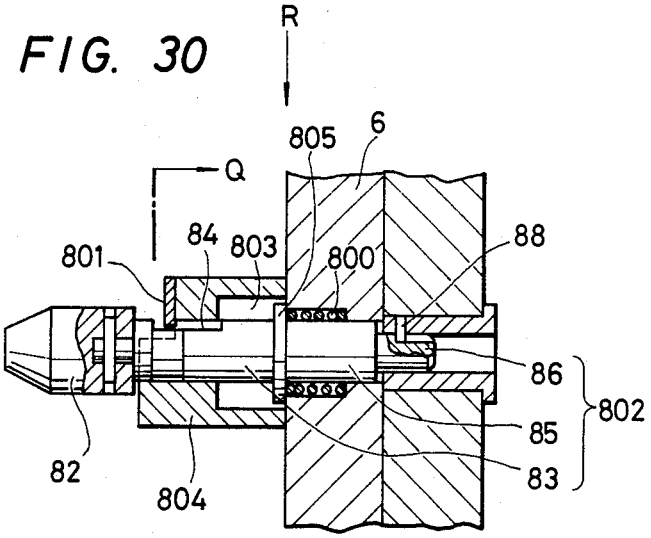
FIG. 30 is a view taken along arrow P in FIG. 7.
Figure 31:
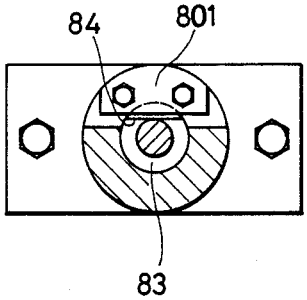
FIG. 31 is a view taken along arrow Q in FIG. 30.
Figure 32:
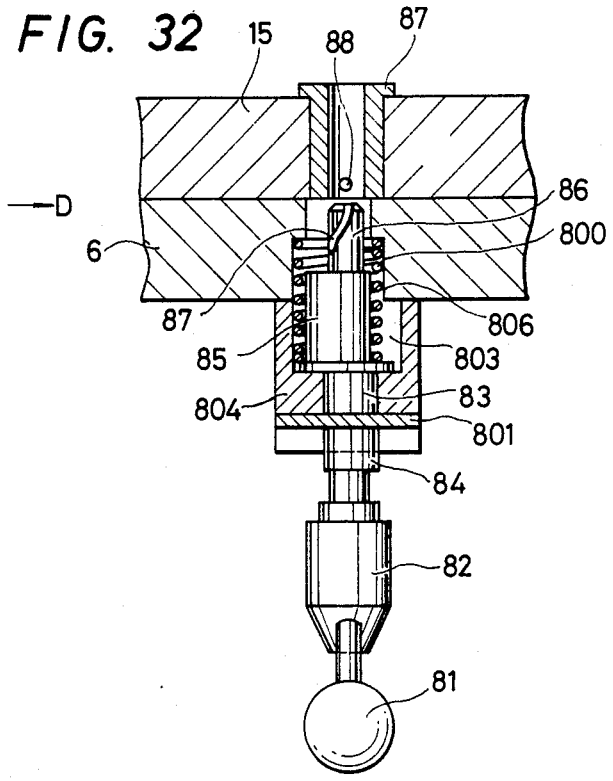
FIG. 32 is a view taken along arrow R in FIG. 30.
Figure 33:
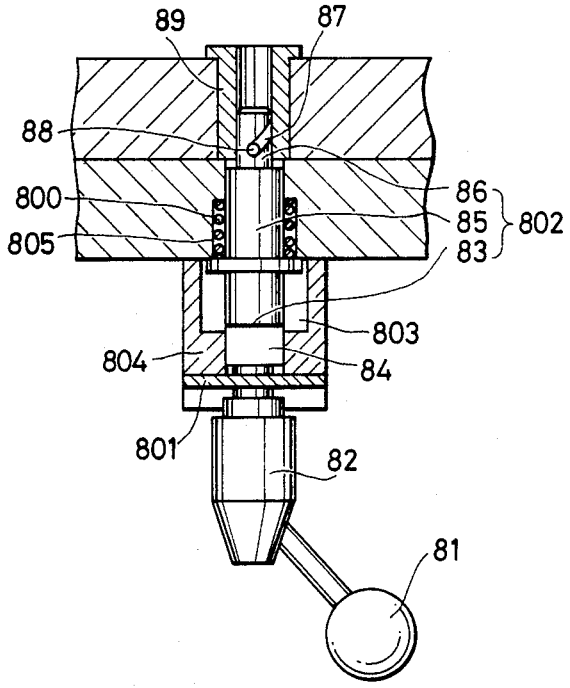
FIG. 33 is a view showing a clamped state.

In FIGS. 30 to 33 showing the construction of the manual clamps 8, FIG. 30 is a view taken along the arrow P in FIG. 7, FIG. 31 is a view taken along the arrow Q of FIG. 30, FIG. 32 a partially sectional view showing the state in which the lever is not turned, and FIG. 33 is a view taken along the arrow R in FIG. 30. FIGS. 30 and 33 show the state in which the lever is turned and clamped.

Reference numerals 81 and 82 indicate a handle and a lever, respectively. Reference numeral 802 indicates a shaft which has a third diameter portion 83, a second diameter portion 85 and a first diameter portion 86. The third diameter portion 83 is partially flattened to form a flat portion 84, which comes into engagement with a pad plate 801 to prevent the shaft from rotation when the lever is inoperative. On the other hand, the second diameter portion 85 is made eccentric to some extent with respect to the first and third diameter portions.

The third diameter portion 83 is positioned in a bracket 804 which is attached to the forming disc 6. The aforementioned pad plate 801 is attached to the bracket 804. This bracket is formed with a recess 803. A flange 805 is formed at the boundary between the third diameter portion 83 and the second diameter portion 85. Between the flange 805 and a notch 806 of the forming disc there is interposed a spring 800 which biases the shaft 802 toward the bracket 804, as shown in FIG. 32. The first diameter portion 86 is formed with a helical groove 87. To the frame 15 there is attached a bushing 89 from which a pin 88 to be fitted in the aforementioned helical groove protrudes.

When a clamping operation is to be executed, the shaft 802 is pushed inward by gripping the handle 81. Then, the flat portion 84 of the third diameter portion 83 comes out of engagement with the pad plate, as shown in FIGS. 30 and 33, to fit the pin 88 in the helical groove 87. If the handle is then turned clockwise to push the shaft as a whole, the pin 88 enters the deepest portion of the helical groove 87, and the flange 805 forces the spring 800 into the notch 806 in close contact with the forming disc 76. As is seen from FIG. 32, the second diameter portion is eccentric but is concentric with the notch 806 of the forming disc 6. In the recess 803 of the bracket 804 a gap is provided so that the eccentric portion 85 can move to the right. In FIG. 32, the arrow D indicates the direction in which the forming disc enters the forming machine. Moreover, the eccentricity of the second diameter portion is made opposite to the advancing direction.

When the handle is turned clockwise to fasten the clamps, the eccentric second diameter portion 5 is turned clockwise. Since the second diameter portion is concentric with the notch 806 of the forming disc 6, moreover, the turns of the eccentric second diameter push the forming disc 6 in the direction of the arrow D, that is, to the right toward the stop 9 (as shown in FIGS. 1 and 28). The forming disc and the frame 15 are brought into close contact with each other by the combination of the helical groove and the pin.

The two handles 120 and 200 may be so automated that they are turned by a motor. The mechanism for transferring the forming disc may be implemented with a chain or a cylinder in place of the threaded shaft. On the hand, the rotating mechanism of the rotary unit of the truck and the drive mechanism for rotating the sun gear may be identical or different. Moreover, the product discharging mechanism may be used as either the mechanism for guiding the material and for moving the core in the mold or the bending mechanism.

We claim:

1. In a forming apparatus for performing bending operations in multiple directions by timing and sequentially operating a multiplicity of bending slides, a forming disc exchanging method comprising the steps of:

preparing: a forming disc having said bending slides, gear means for actuating said bending slides, product discharging means, and a mold; a main forming machine having said forming disc removably attached thereto; and a truck having said forming disc removably attached thereto, said truck having drive means for turning said gear means; and transferring and exchanging said forming disc between said truck and said main forming machine.

2. In a forming apparatus using a forming disc for performing bending operations in multiple directions by timing and sequentially operating a multiplicity of bending slides, a method of exchanging the forming disc with a replacement forming disc comprising the steps of:

providing a forming machine having said forming disc removably attached thereto, said forming machine also having first guide means associated therewith;

providing a truck for removably attaching said replacement forming disc thereto, said truck having drive means for driving said replacement disc, said truck also having second and third guide means associated therewith;

preparing a pre-set replacement forming disc, said preparing step including the steps of mounting said replacement forming disc on said truck utilizing said third guide means using said drive means for adjusting said replacement forming disc, said replacement forming disc having said bending slides, a product discharging means and a mold;

moving said truck beside said forming machine, said pre-set replacement forming disc moving with said truck;

connecting said forming machine with said truck;

aligning said first guide means with said third guide means;

transferring said forming disc from said forming machine to said truck by sliding said forming disc from said first guide means to said third guide means;

turning said truck by 180 degrees after receiving said forming disc on said truck;

aligning said first guide means with said second guide means;

transferring said replacement forming disc to said forming machine by sliding said forming disc from said second guide means to said first guide means; and disconnecting said truck from said forming machine.

3. A forming apparatus for performing bending operations in multiple directions by timing and sequentially operating a multiplicity of bending slides, comprising:

a forming disc including a multiplicity of bending slides, gear means for actuating said bending slides, product discharging means, and a mold;

a main forming machine having said forming disc removably attachable thereto and including first guide means for allowing said disc to slide thereon; and a truck having said forming disc removably attached thereto, said truck having drive means for turning said gear means, second guide means cooperatingly alignable with said first guide means for allowing said disc to slide thereon, and transfer means for sliding and transferring said forming disc between said machine and said truck.

4. The forming apparatus as set forth in claim 2, wherein ones of said guide means are provided in at least two positions on a table of said truck, and wherein said table is swivelably mounted.

5. The forming apparatus as set forth in claim 3, wherein said first guide means and said second guide means comprise grooved guides having tapered portions extending in their longitudinal directions.

6. The forming apparatus as set forth in claim 2, wherein said main forming machine and said truck further comprise means for joining said main forming machine and said truck.

7. The forming apparatus as set forth in claim 6, wherein said joining means comprises: a first bracket to which is affixed a first pin; a second bracket having a groove having tapered and straight portions engageable with said first pin; and a second pin inserted in said first bracket and said second bracket.

8. The forming apparatus as set forth in claim 2, wherein said forming disc is formed at its end portion with a first taper extending in the sliding direction thereof, and wherein said main forming machine has a second taper to engage with said first taper.

9. The forming apparatus as set forth in claim 2, wherein said forming disc is removably attached to said main forming machine by means of a plurality of clamps.

10. The forming apparatus as set forth in claim 9, wherein at least one of said clamps comprises: a pin and a bushing disposed at said main forming machine; a bracket disposed at said forming disc; a shaft received in said bracket and having a first diameter portion fitted in said bushing and a second diameter portion eccentric with respect to said first diameter portion; a helical groove formed in said first diameter portion; a pin protruding inwardly of said bushing; and a spring for biasing said shaft apart from said forming disc.

11. The forming apparatus as set forth in claim 3, wherein said table is swivelably mounted to swivel in two directions.

* * * * *

UNITED STATES PATENT AND TRADEMARK OFFICE

CERTIFICATE OF CORRECTION

PATENT NO. : 4,581,917

DATED : April 15, 1986

INVENTOR(S) : Yukinori Moriyama and Kazuhide Kodama

It is certified that error appears in the above-identified patent and that said Letters Patent is hereby corrected as shown below:

In claim 4, line 1, change "claim 2," to --claim 3,--

In claim 6, line 1, change "claim 2," to --claim 3,--

In claim 8, line 1, change "claim 2," to --claim 3,--

In claim 9, line 1, change "claim 2," to --claim 3,--

In claim 11, line 1, change "claim 3," to --claim 4,--

Signed and Sealed this

Nineteenth Day of July, 1988

*Attest:*

DONALD J. QUIGG

*Attesting Officer*

*Commissioner of Patents and Trademarks*